US007445176B2

(12) United States Patent
Byrd

(10) Patent No.: US 7,445,176 B2
(45) Date of Patent: Nov. 4, 2008

(54) PAPER ROLL HOLDER

(76) Inventor: Victor Todd Byrd, 5406 Eastwind Rd., Wilmington, NC (US) 28403

( * ) Notice: Subject to any disclaimer, the term of this patent is extended or adjusted under 35 U.S.C. 154(b) by 0 days.

(21) Appl. No.: 11/890,324

(22) Filed: Aug. 6, 2007

(65) Prior Publication Data

US 2008/0042004 A1 Feb. 21, 2008

Related U.S. Application Data

(60) Provisional application No. 60/837,718, filed on Aug. 15, 2006.

(51) Int. Cl.
*B65H 75/18* (2006.01)

(52) U.S. Cl. ..... 242/597.6; 242/599.4

(58) Field of Classification Search ..... 242/597, 242/597.5, 597.8, 599, 599.2, 599.4; D6/518–523, D6/546–550
See application file for complete search history.

(56) References Cited

U.S. PATENT DOCUMENTS 2,392,996 A * 1/1946 Poirier ..... 242/597.5
2,424,307 A * 7/1947 Dunbar ..... 242/597.5
2,661,165 A * 12/1953 Salmonson ..... 242/597
2,861,751 A * 11/1958 Sarro ..... 242/597
2,994,488 A * 8/1961 Waddell ..... 242/597.5
3,061,217 A 10/1962 Grant
3,227,386 A * 1/1966 Pitcher ..... 242/597.5
3,228,618 A * 1/1966 Bracken ..... 242/597.5
3,482,796 A * 12/1969 Tucker ..... 242/597.5
4,149,680 A 4/1979 Whatley
4,222,532 A 9/1980 DeLuca
4,595,153 A * 6/1986 Goetz ..... 242/597
4,690,343 A * 9/1987 Goetz ..... 242/597
4,919,350 A 4/1990 Miller
5,348,241 A * 9/1994 Huette ..... 242/597.5
5,799,895 A * 9/1998 Michaud et al. ..... 242/597.5
5,938,142 A 8/1999 Halperin
6,786,448 B2 * 9/2004 Arcilesi ..... 242/597.5

* cited by examiner

*Primary Examiner*—William A Rivera
(74) *Attorney, Agent, or Firm*—MacCord Mason PLLC

(57) ABSTRACT

A paper roll holder including a spindle having a diameter less than the inner diameter of a roll core, a means to support the spindle, and a wedge-shaped projection extending from the spindle. The combined width of the spindle and the wedge at one end is greater than the core inner diameter, while the remainder of the spindle and wedge combined width is less than the core inner diameter. To remove a sheet from a paper roll, a user will pull on an outer sheet by its edge in a direction that is perpendicular to the spindle causing the roll to spin until a desired number of sheets are unwound from the roll. Next, the user will pull the outer towel sheet in the direction of the sloping wedge-shaped projection. This action will force the roll core edge to engage a roll core engagement edge on the wedge-shaped projection outer edge, thereby causing the towel roll to stop spinning and allow the desired number of towel sheets to be detached from the towel roll.

14 Claims, 5 Drawing Sheets

PAPER ROLL HOLDER

This application claims the benefit of the filing date of U.S. Provisional Application Ser. No. 60/837,718, filed Aug. 15, 2006.

BACKGROUND OF THE INVENTION (1) Field of the Invention

The present invention relates generally to a holder for a roll of perforated paper sheets, such as a roll of paper towels or toilet paper around an inner core that includes a means to stop rotation of the roll when the sheets are to be separated, preventing overspin of the roll.

(2) Description of the Prior Art

Paper towel and toilet tissue holders have been designed and constructed to reduce the amount of excess paper unwound from a paper towel or toilet tissue roll. In most instances, these "prior art" holders have a complex construction involving springs and roll grippers. These types of holders are relatively expensive to manufacture and are not robust enough for commercial settings. Other "prior art" holders such as the one described in U.S. Pat. No. 4,149,680 to Whately are of very simple construction. However, such holders present their own disadvantages. For example, the holder disclosed by Whately includes a flat sheet metal arm for holding a roll of tissue paper. The disclosed arm also includes an upwardly extending hook for braking a spinning roll as a tissue sheet is torn from the roll. However, if the roll is rapidly rotated as children sometimes rotate tissue rolls, the roll is likely to jump over the hook and become lodged within the core of the roll. Thereby presenting a jammed roll for the next user. What is needed is a holder for paper towels and toilet tissue that has a simple construction and will not become jammed even under conditions of misuse.

SUMMARY OF THE INVENTION

The present invention addresses the above need by providing a holder of simple construction for a roll of perforated paper sheets that includes a means to stop rotation of the roll when the sheets are to be separated. The holder of the present invention is particularly useful for preventing overspin and jamming of the roll.

In general, the holder comprises a spindle having a diameter less than the inner diameter of the roll core, a means to support the spindle in a desired orientation, and a wedge-shaped projection extending radially outward from the spindle. The combined width of the spindle and the wedge at one end is greater than the core inner diameter, while the remainder of the spindle and wedge combined width is less than the core inner diameter. A roll of perforated paper sheets on the spindle can rotate freely during the unwinding of paper sheets. However, axial movement of the roll toward the larger end of the wedge causes frictional engagement of the roll core and spindle/wedge, preventing rotation of the roll. Moreover, the roll has no opportunity to jam on the wedge due to the gradual increase in the spindle and wedge combined diameter. It is also important to note that the unique construction of the present invention allows it to accommodate many different sizes of paper roll cores and still work properly.

In one embodiment, the spindle is made of round stock such as a wooden dowel, or metal or plastic rod having a distal end for supporting the spindle and a proximal end usable for paper roll loading. The proximal end includes a stub perpendicular to the spindle for maintaining the paper roll on the spindle. A wedge-shaped projection extends from the spindle.

In this embodiment, the wedge-shaped projection has an elongated leg attached to the spindle along the length of the spindle, and a base leg extending radially outward from the spindle distal end. An outer side of the wedge-shaped projection has a paper roll core engagement edge that is inclined outwardly towards the base leg, thereby making up the hypotenuse of a right triangle that includes the elongated and base legs of the wedge-shaped projection.

The wedge-shaped projection outer edge slopes away from the spindle such that roll core engagement with the core engagement edge occurs where the combined diameter of the spindle, together with the increasing width of the wedge-shaped projection exceeds the core diameter of a paper roll held by the spindle. Moreover, the distance between where roll core engagement occurs with the core engagement edge and the paper roll loading end stub is at least greater than the width of a paper roll held by the holder.

Furthermore, the roll engagement edge of the wedge-shaped projection is sufficiently sharp to capture the edge of the roll core to stop roll rotation such that a roll sheet will tear away from the roll when pulled forcefully. The preferred outer edge is formed where the intersection of two perpendicular planes of material making up the wedge shape projection comes together.

The combined wedge-shaped projection and spindle can be mounted directly to a wall or to a wall mounting plate that can be mounted to a wall such that the spindle extends horizontally from the wall. Optionally, the wall mounting plate having a top edge can include a ceiling mounting plate that attaches to the wall mounting plate top edge and extends above and parallel to the spindle. The ceiling mounting plate is spaced above the spindle at a distance that allows at least an average size paper towel roll to be freely rotated about the spindle. Preferably, both the wall mounting plate and the ceiling mounting plate include manufactured screw holes for quick and easy installation of the towel holder.

In another embodiment of the present invention, the spindle and wedge-shaped projection is made from a continuous stiff wire form having elongated co-planar sections. The wire form includes a first elongated section having a first wall mounting end and a paper roll-retaining end in the shape of a half loop that extends perpendicular to the elongated section. The half loop has an outer end that extends below the first elongated section when the elongated section is held in a horizontal position. A second elongated section shorter than the first elongated section is attached to the half loop outer end and extends in the direction of the first wall-mounting end and is parallel to the first elongated section. A third elongated section continues from the second section and slopes away from the first elongated section. A paper roll core engagement edge exists on the third elongated section at a location where the distance between the first elongated section and the third elongated section is greater than the core diameter of a paper towel or toilet tissue roll. Moreover, the distance between the roll core engagement edge and the towel roll retaining end half loop is at least greater than the width of the average paper towel or toilet tissue roll.

The continuous stiff wire form making up the spindle and wedge of this embodiment can be mounted directly to a wall or to a wall mounting plate that can be mounted to a wall such that the spindle extends horizontally from the wall. Optionally, the wall mounting plate having a top edge can include a ceiling mounting plate that attaches to the wall mounting plate top edge and extends above and parallel to the spindle. The ceiling mounting plate is spaced above the first elongated section at a distance that allows at least an average size paper towel or toilet tissue roll to be freely rotated. Preferably, both the wall mounting plate and the ceiling mounting plate include manufactured screw holes for quick and easy installation of the towel holder.

Other embodiments include the basic structures of the above embodiments and are mounted in a substantially vertical orientation. However, it is preferred that the spindle be mounted slightly off vertical such that a held paper roll will be more free to rotate at the beginning of the paper sheet removal process.

In these vertically oriented embodiments, a substantially heavy base plate is used in place of the wall mounting plate. In this way, the paper roll holders are portable and can be moved from, e.g., one kitchen counter top to another. A suitable base plate is a heavy disk made of granite. It is preferred that the weight of the base plate be substantially heavier than the paper roll, spindle and wedge that it supports. Moreover, it is preferable for the base plate to have a diameter that slightly exceeds the diameter of a new paper roll to be held by the roll holder.

In operation of any embodiment, a roll core is loaded onto the spindle by passing the core over the roll-retaining stub and onto the spindle. To remove a sheet from the towel roll, a user will pull on an outer sheet by its edge in a direction that is perpendicular to the spindle causing the roll to spin until a desired number of sheets are unwound from the roll. Next, the user will pull the outer towel sheet in the direction of the spindle distal end. This action will force the paper core edge closest to the spindle distal end to engage the paper roll core engagement edge on the wedge-shaped projection outer side, thereby causing the towel roll to stop spinning and allow the desired number of paper sheets to be detached from the paper roll.

Other aspects of the invention will become apparent to one skilled in the art upon a reading of the following detailed description of the invention, taken with the drawings.

DETAILED DESCRIPTION OF THE INVENTION

In the following description, terms such as horizontal, upright, vertical, above, below, beneath and the like are used solely for the purpose of clarity in illustrating the invention, and should not be taken as words of limitation. The drawings are for the purpose of illustrating the invention and are not to be intended to be to scale.

Figure 1:
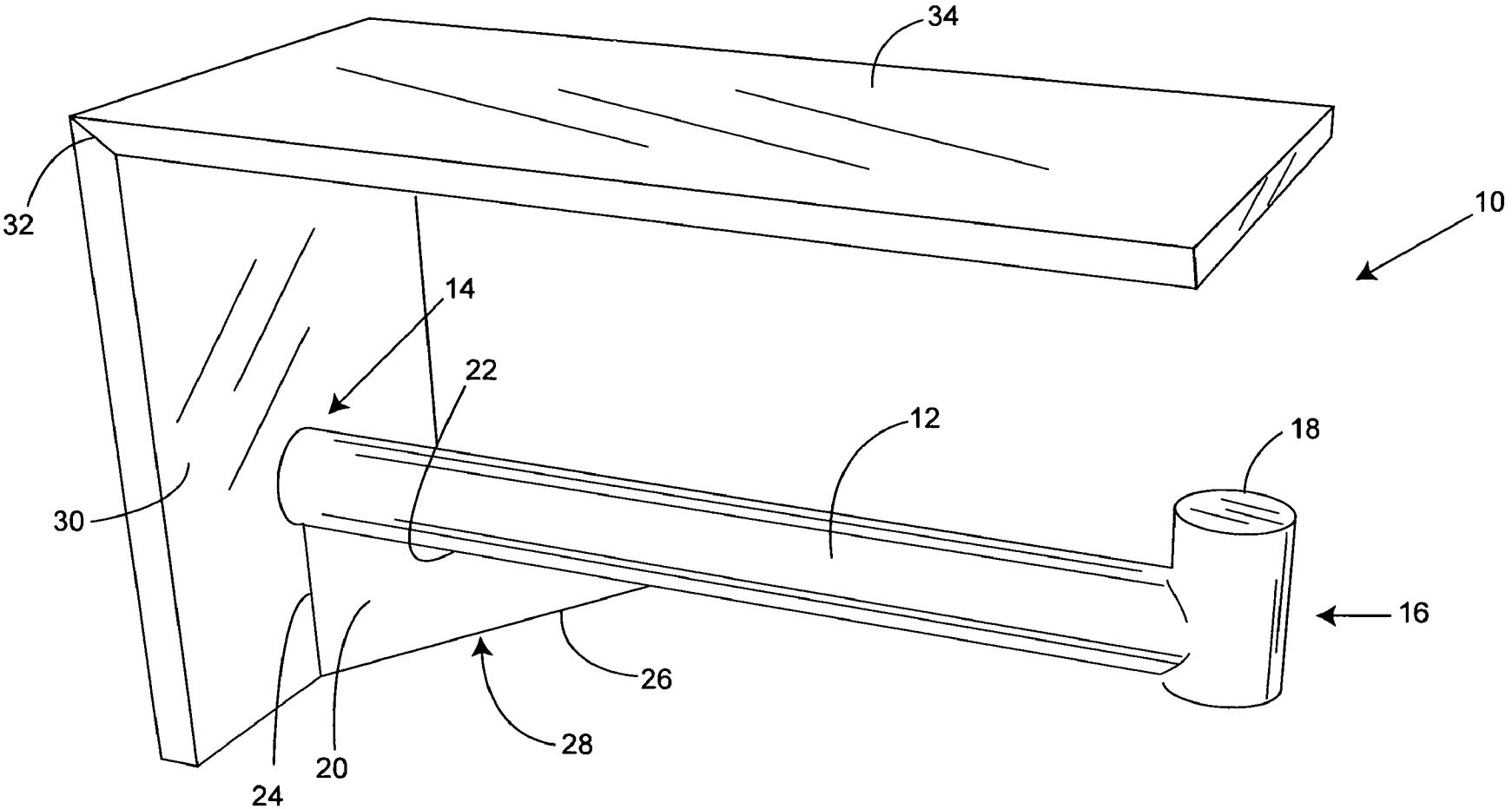
FIG. 1 is a perspective view of the preferred embodiment of the paper roll holder of the present invention.

FIG. 1 shows a perspective view of the preferred embodiment of the paper roll holder, generally 10. Paper roll holder 10 comprises a spindle 12 that is made of round stock such as a wooden dowel, or metal or plastic rod having a distal end 14 and a proximal end 16. Proximal end 16 includes an upwardly extending stub 18 for keeping a paper roll on spindle 12. A wedge-shaped projection 20 extends radially outward from spindle 12. In this preferred embodiment, the wedge-shaped projection 20 has an elongated leg 22 attached to spindle 12 along the length of spindle 12, and a base leg 24 extending radially outward from spindle distal end 14. An outer side 26 of wedge-shaped projection 20 inclines away from spindle 12 in a direction towards base leg 24, thereby making up the hypotenuse of a right triangle that includes the elongated and base legs of the wedge-shaped projection. The wedge-shaped projection outer side 26 includes a roll core engagement edge 28 that slopes away from spindle 12 such that the combined diameter of spindle 12 together with the increasing width of wedge-shaped projection 20 exceeds the core diameter of a roll held by the spindle. Moreover, the distance between where roll core engagement occurs with core engagement edge 28 and paper roll loading end stub 18 is at least greater than the width of a paper roll held by the holder.

The combined wedge-shaped projection 20 and spindle 12 can be mounted directly to a wall or to a wall mounting plate 30 that can be mounted to a wall such that spindle 12 extends horizontally from the wall. Optionally, wall mounting plate 30 having a top edge 32 can include a ceiling mounting plate 34 that attaches to the wall mounting plate top edge 32 and extends above and parallel to spindle 12. Ceiling mounting plate 34 is spaced above spindle 12 at a distance that allows at least an average size paper towel roll to be freely rotated about spindle 12. Preferably, both wall mounting plate 30 and ceiling mounting plate 34 include manufactured screw holes for quick and easy installation of paper roll holder 10.

Figure 2:
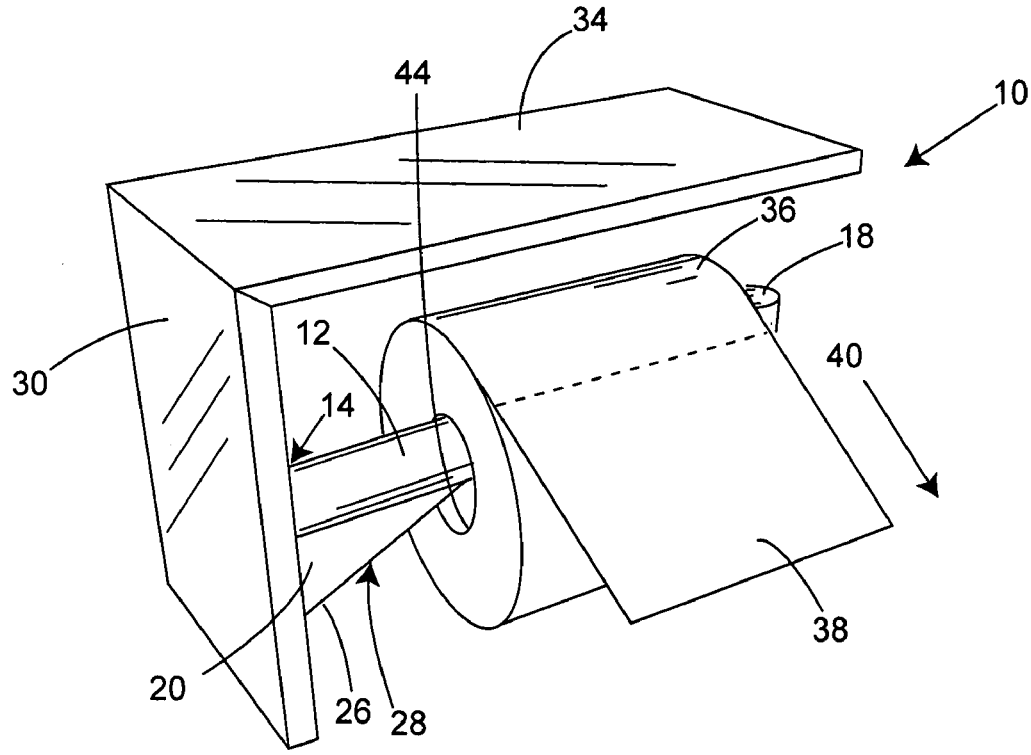
FIG. 2 is a perspective view of the paper roll holder of FIG. 1 showing a paper sheet being pulled directly off a paper roll such that the paper roll rotates freely about the spindle.

FIG. 2 depicts a towel roll 36 having a roll core 44 being held by paper roll holder 10. A sheet 38 is being pulled straight off roll 36 in the direction of arrow 40. As paper sheet 38 is being pulled in this direction roll 36 will freely rotate about spindle 12.

Figure 3:
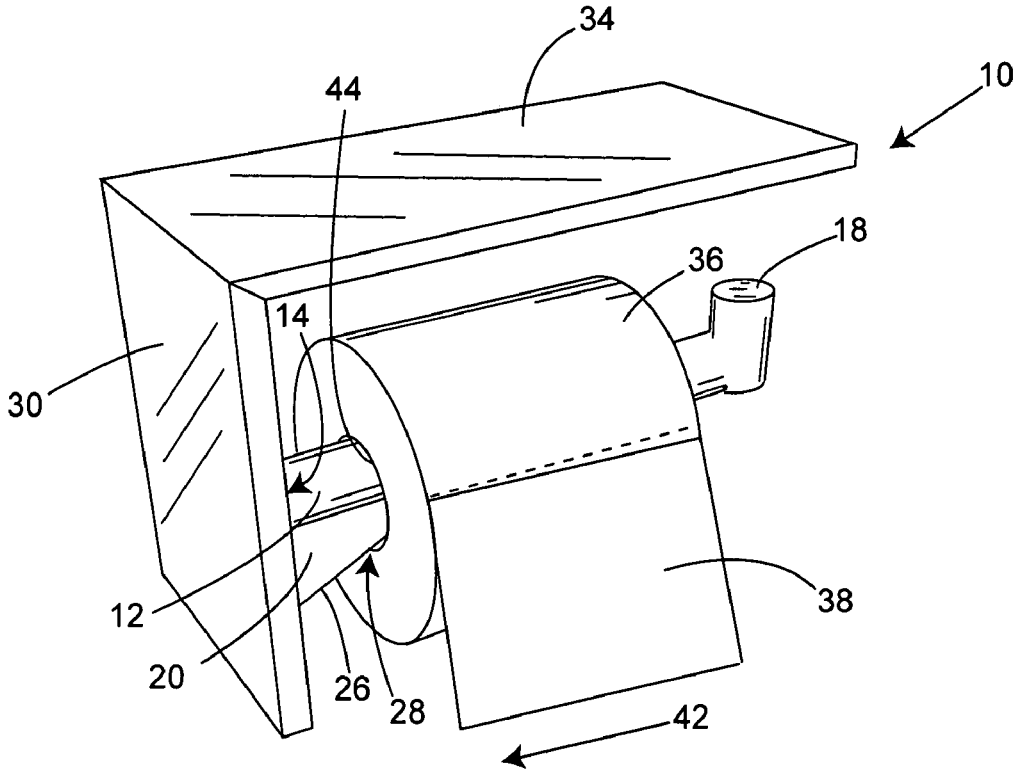
FIG. 3 is a perspective view of the towel holder of FIG. 1 showing a paper sheet being pulled in the axial direction of the spindle causing the roll core to engage the outer surface of the wedge-shaped projection.

FIG. 3 depicts sheet 38 being pulled in the axial direction of spindle 12 as denoted by arrow 42. As a result of the pull of sheet 38, roll 36 is dragged towards roll core engaging edge 28. As the axial pull of roll 36 is continued, the roll core 44 engages roll core engaging edge 28 of wedge outer side 26, which brakes the rotation of roll 36 and simultaneously allows sheet 38 to be torn free of roll 36. After sheet 38 is torn free, the next user will pull another sheet in the direction of arrow 40 to begin again the rotation of roll 36 about spindle 12, thus starting another towel removal sequence.

Figure 4:
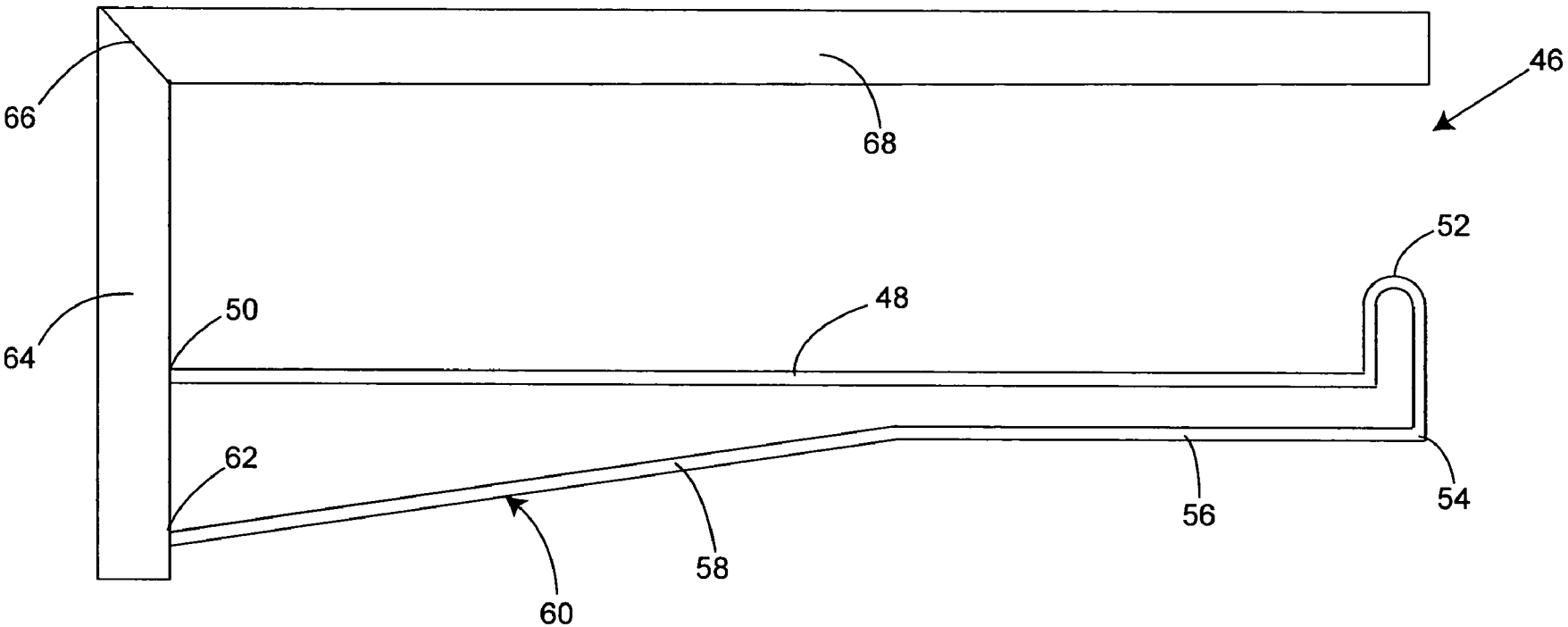
FIG. 4 is a plan view of a wire form embodiment of the paper holder of the present invention.

FIG. 4 depicts another embodiment of a towel holder, generally 46. In this embodiment of the present invention, the spindle and wedge-shaped projection is made from a continuous stiff wire form having elongated co-planar sections. The wire form includes a first elongated section 48 having a first wall mounting end 50 and a paper roll-retaining end 52 in the shape of a half loop that extends perpendicular to first elongated section 48. The half loop has an outer end 54 that extends below first elongated section 48 when first elongated section 48 is mounted in a horizontal position. A second elongated section 56 is shorter than first elongated section 48 and is attached to half loop outer end 54 and extends in the direction of first wall-mounting end 50 and is parallel to first elongated section 48. A third elongated section 58 continues from second section 56 and slopes away from first elongated section 48 until it terminates with a second wall mounting end 62. A paper roll core engagement edge 60 exists on third elongated section 58 at a location where the distance between first elongated section 48 and third elongated section 58 is greater than the core diameter of a paper roll. Moreover, the distance between roll core engagement edge 60 and paper roll retaining end 52 at the location where roll core engagement occurs is at least greater than the width of the average paper towel roll or tissue roll. Different diameter roll cores will engage roll core engagement edge 60 at different locations along roll core engagement edge 60. As a result, the present invention is flexible in that it can accommodate many different sizes of paper roll cores.

The continuous stiff wire form making up the spindle and wedge of this embodiment can be mounted directly to a wall or to a wall mounting plate 64 that can be mounted to a wall such that the spindle extends horizontally from the wall. Optionally, the wall mounting plate having a top edge 66 can include a ceiling mounting plate 68 that attaches to wall mounting plate top edge 66 and extends above and parallel to the spindle. Ceiling mounting plate 68 is spaced above first elongated section 48 at a distance that allows at least an average size paper towel roll or tissue roll to be freely rotated about first elongated section 48. Preferably, both the wall mounting plate 64 and the ceiling mounting plate 68 include manufactured screw holes for quick and easy installation of the towel holder.

Figure 5:
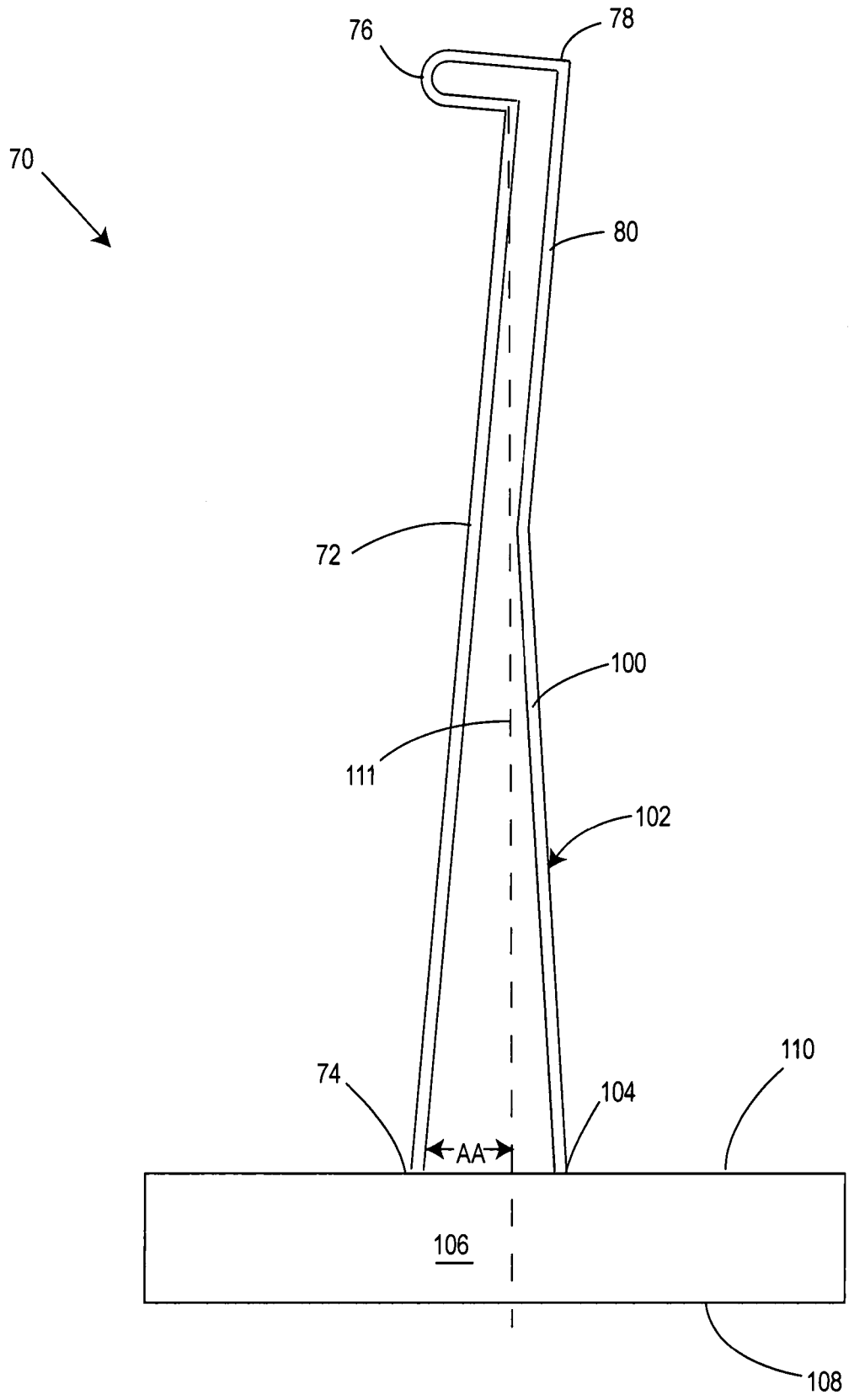
FIG. 5 is a plan view of a wire form embodiment mounted on a base plate such that the spindle is in a substantially vertical orientation.

FIG. 5 depicts another embodiment of a towel holder, generally 70. In this embodiment of the present invention, the spindle and wedge-shaped projection is made from a continuous stiff wire form having elongated co-planar sections. The wire form includes a first elongated section 72 having a first base plate mounting end 74 and a paper roll-retaining end 76 in the shape of a half loop that extends perpendicular to first elongated section 72. The half loop has an outer end 78 that extends outward from first elongated section 72 when first elongated section 72 is mounted in a vertical orientation.

A second elongated section 80 is shorter than first elongated section 72 and is attached to half loop outer end 78, and extends parallel to first elongated section 72 in the direction of first wall-mounting end 74. A third elongated section 100 continues from second section 80 and slopes away from first elongated section 72 until it terminates with a second base plate mounting end 104.

A paper roll core engagement edge 102 exists on third elongated section 100 at a location where the distance between first elongated section 72 and third elongated section 100 is greater than the core diameter of a paper roll. Moreover, the distance between roll core engagement edge 102 and paper roll retaining end 76 at the location where roll core engagement occurs is at least greater than the width of the average paper towel roll or tissue roll.

The continuous stiff wire form making up the spindle and wedge of this embodiment is mounted directly to a base plate 106 having a bottom surface 108 and top surface 110. The spindle extends substantially vertically from base plate top surface 110 when base plate bottom surface 108 rests upon a surface such as a kitchen counter top.

As shown in FIG. 5, spindle first elongated section 72 deviates from the vertical, represented by dashed line 111, by an angle AA so that a paper roll will rotate more freely as the process of removing a paper sheet begins. The angle AA is preferably between zero and ten degrees.

Figure 6:
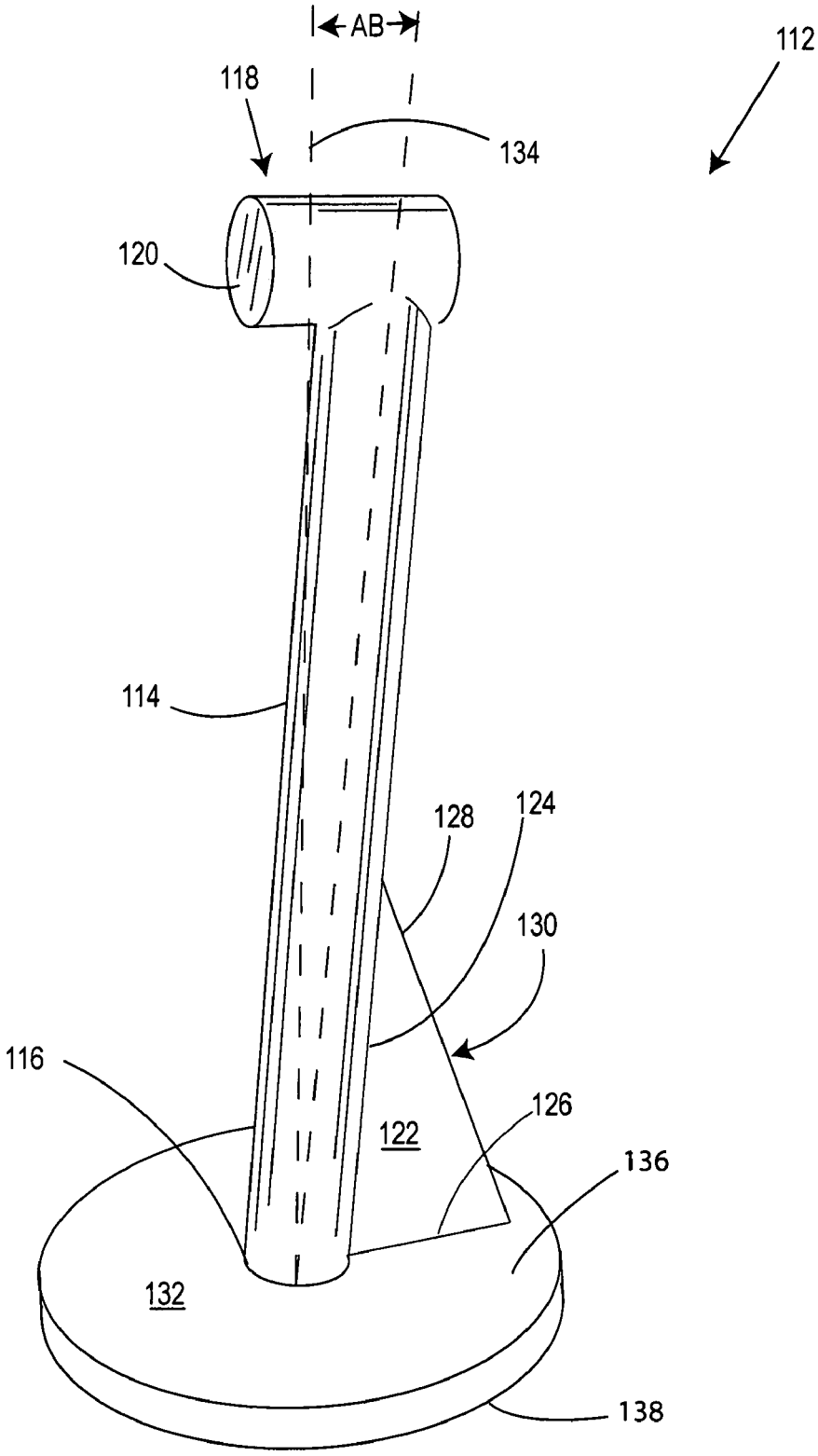
FIG. 6 is a perspective view of a vertical orientation of the preferred structure similar to that of FIG. 1.

FIG. 6 depicts yet another embodiment of the present invention. In this embodiment a paper roll holder 112 comprises a spindle 114 that is made of round stock such as a wooden dowel, or metal or plastic rod having a distal or support mounting end 116 and a proximal or roll-loading end 118. Roll-loading end 118 includes an outwardly extending stub 120 for keeping a paper roll on spindle 114. A wedge-shaped projection 122 extends outwardly from spindle 114.

In this embodiment, the wedge-shaped projection 122 has an elongated leg 124 attached to spindle 114 along the length of spindle 114, and a base leg 126 extending radially outward from spindle support-mounting end 116. An outer side 128 of wedge-shaped projection 122 slopes away from spindle 114 in a direction towards base leg 126, thereby making up the hypotenuse of a right triangle that includes the elongated and base legs of the wedge-shaped projection. The wedge-shaped projection outer side 128 includes a roll core engagement edge 130 that slopes away from spindle 114 such that roll engagement will occur where the combined diameter or width of spindle 114 together with the increasing width of wedge-shaped projection 122 exceeds the core diameter of a roll held by the spindle. Moreover, the distance between the roll core engagement edge 130 and the paper roll loading end stub 120 at the location where roll core engagement occurs is at least greater than the width of the average paper towel roll or average size tissue roll.

The combined wedge-shaped projection 122 and spindle 114 can be mounted directly to a base plate 132 such that spindle 1 14 extends substantially vertically from base plate top surface 136 when base plate bottom surface 138 rests upon a kitchen counter top, etc. As shown in FIG. 6, spindle 114 deviates from the vertical, represented by dashed line 134, by an angle AB so that a paper roll will rotate more freely as the process of removing a paper sheet begins. The angle AB is preferably between zero and ten degrees.

Certain modifications and improvements will occur to those skilled in the art upon a reading of the foregoing description. Such modifications and improvements have been deleted herein for the sake of conciseness and readability but are properly within the scope of the present invention.

What is claimed is:

1. A paper roll holder for a paper roll having a hollow roll core with a given core diameter, said holder comprising:

a) a spindle having a proximal and a distal end, said spindle having a diameter that is less than the diameter of the paper roll core, and a length greater than the paper roll's width;

b) a means to support said spindle in a horizontal orientation; and c) a wedge-shaped projection extending radially outward from said spindle distal end, wherein a roll core engagement point is located on said wedge-shaped projection where the combined diameter of said spindle, together with the increasing width of said wedge-shaped projection exceeds said core diameter of a paper roll held by the spindle.

2. The paper roll holder of claim 1, wherein said wedge-shaped projection has an elongated leg attached to said spindle along the spindle length, and a base leg extending radially outward from said spindle distal end.

3. The paper roll holder of claim 2, wherein said wedge-shaped projection includes an outer side with a core engagement edge inclined outwardly towards said base leg, thereby making up the hypotenuse of a right triangle that includes said elongated and base legs of the wedge-shaped projection.

4. The paper roll holder of claim 3, wherein said proximal end includes an upwardly extending stub for keeping a roll on said spindle.

5. The paper roll holder of claim 4, wherein the distance between where roll core engagement occurs with said core engagement edge and the paper roll loading end stub is at least greater than the width of a paper roll held by said holder.

6. The paper roll holder of claim 1, wherein said spindle is made of round stock from the group of materials consisting of wood, metal, plastic and combinations thereof.

7. A paper roll holder for a paper roll having a hollow roll core, said holder comprising a spindle and wedge-shaped projection that is made from a continuous stiff wire form having elongated co-planar sections comprising:

a ) a first elongated section having a first substrate mounting end and a roll-retaining end in the shape of a half loop that extends perpendicular to the elongated section, wherein said half loop has an outer end that extends beyond said first elongated section;

b) a second elongated section shorter than said first elongated section is attached to said half loop outer end and extends in the direction of said first substrate mounting end and is parallel to said first elongated section; and c) a third elongated section that continues from said second section and slopes away from said first elongated section until it terminates with a second substrate mounting end such that a paper roll core engagement edge exists on said third elongated section at a location where the distance between said first elongated section and said third elongated section is greater than the core diameter of a roll to be held on said holder, wherein the distance between where roll core engagement occurs with said core engagement edge and said paper roll loading end stub is at least greater than the width of the roll held by said holder.

8. A paper roll holder for a paper roll having a hollow roll core with a given core diameter, said paper roll holder comprising:

a) a spindle having a proximal end and a distal end, said spindle having a diameter that is less than the diameter of the paper roll core, and a length greater than the paper roll's width;

b) a base-plate to support said spindle in a substantially vertical orientation; and c) a wedge-shaped projection extending from said spindle distal end, wherein a roll core engagement point is located on said wedge-shaved projection where the combined diameter of said spindle, together with the increasing width of said wedge-shaved projection exceeds said core diameter of a paper roll held by the spindle.

9. The paper roll holder of claim 8, wherein said wedge-shaped projection has an elongated leg attached to said spindle along the spindle length, and a base leg extending radially outward from said spindle distal end.

10. The paper roll holder of claim 9, wherein an outer side of said wedge-shaped projection has a paper roll core engagement edge that inclines outwardly towards said base leg, thereby making up the hypotenuse of a right triangle that includes the elongated and base legs of the wedge-shaped projection.

11. The paper roll holder of claim 8, wherein said spindle proximal end includes an outwardly extending stub for keeping a paper roll on said spindle.

12. The paper roll holder of claim 11, wherein the distance where roll core engagement occurs with said core engagement edge and the paper roll loading end stub is at least greater than the width of the roll held by said holder.

13. The paper roll holder of claim 8, wherein said spindle leans from vertical at an angle from between 0 degrees and 10 degrees.

14. The paper roll holder of claim 8, wherein said base-plate weighs substantially more than the combined weight of the paper roll to be held by said holder.

* * * * *